United States Patent [19]

Stewart et al.

[11] 4,346,530

[45] Aug. 31, 1982

[54] LEATHER INLAY PISTOL GRIP AND METHOD OF MANUFACTURE

[76] Inventors: Finton E. Stewart; Sylvia M. L. B. Stewart, both of P.O. Box 2863, Flagstaff, Ariz. 86003

[21] Appl. No.: 135,499

[22] Filed: Mar. 31, 1980

[51] Int. Cl.[3] ..... F41C 23/00

[52] U.S. Cl. ..... 42/71 R; 42/71 P

[58] Field of Search ..... 42/71 P, 71 R, 74

[56] References Cited

U.S. PATENT DOCUMENTS

| | | | |
|---|---|---|---|
| 1,693,289 | 11/1928 | Warren | 42/71 R |
| 2,308,627 | 1/1943 | Rickenbacher | 42/71 P |
| 2,331,372 | 10/1943 | Buchanan, Jr. | 42/71 R |
| 2,701,930 | 2/1955 | Dolan | 42/71 R |

*Primary Examiner*—Charles T. Jordan

*Attorney, Agent, or Firm*—Cahill, Sutton & Thomas

[57] ABSTRACT

A pair of tooled leather inlays are adhesively attached to bottom surfaces of a pair of inlay grooves disposed in a pair of wooden grip members attached to the handle of a pistol.

7 Claims, 6 Drawing Figures

LEATHER INLAY PISTOL GRIP AND METHOD OF MANUFACTURE

BACKGROUND OF THE INVENTION

1. Field of the Invention

The invention relates to gripping surfaces for firearms, and more particularly, to inlaid grip surfaces for firearms, including pistols, rifles and shotguns.

2. Description of the Prior Art

Firearms, such as pistols, rifles and shotguns are commonly provided with "checkered" gripping surfaces disposed along the portions of the pistol grips, or gun stocks which will be grasped by the hands of the user during deployment of the firearms. The checkered gripping surfaces typically consist of a pattern of mutually parallel and perpendicular or inclined spaced grooves providing square or diamond patterns in the pistol grip or gun stock materials, which are usually composed of hardwood. Various clear finishes are usually applied to the gun stocks or pistol grips, after the checkering process to protect the wood from moisture and to enhance the beauty of the wood. Unfortunately, the grooves of the checkered surfaces often tend to become filled with the finish materials, resulting in loss of gripping capability of the checkered surfaces.

Accordingly, it is an object of the invention to provide improved gripping surfaces for hand-held firearms.

In the past, gripping surfaces other than wood have been utilized. For example, checkered inlaid plastic grips or gripping panels have been utilized. Checkered inlaid gripping panels formed of plastic or hardwood have been utilized. However, all known prior gripping surfaces for firearms have been composed of very hard materials which, despite having the above mentioned gripping surfaces, have not provided optimum gripping ability under the wide variety of conditions under which users utilize their firearms. For example, in hot weather or under humid conditions, perspiration or moisture on the gripping hand of the user causes loss of friction between the hard moisture proof surfaces of prior hand-held firearms. Thus, there is an unmet need for an improved method and structure for providing gripping surfaces for hand-held firearms which overcome the shortcomings of the known prior art, believed to be indicated by U.S. Pat. Nos. 616,424, 836,851, 1,693,289, 2,331,372, 2,701,930, 3,815,270, 4,043,066 and 4,098,015.

Accordingly, it is another object of the invention to provide an improved gripping structure and method of manufacture for firearms, which method and structure overcome the above mentioned shortcomings of the prior art.

Many owners of hand-held firearms take pride in the condition and appearance of their firearms. Such owners frequently have custom made gun stocks, pistol grips, and the like for their firearms. The custom made grips, gun stocks and the like frequently have decorative patterns carved in the wood of which the pistol grips, gun stocks and the like are composed. Occasionally, the owners would like to be able to easily modify the appearance of the gun stocks, pistol grips, etc., especially the gripping surfaces thereof.

Accordingly, it is yet another object of the invention to provide decorative gripping surfaces for hand-held firearms which can be relatively easily removed and replaced.

Yet another object of the invention is to provide gripping surfaces for hand-held firearms which are substantially less hard and provide a more resilient or cushioned gripping surface than the hard, uncomfortable gripping surfaces of the prior art.

SUMMARY OF THE INVENTION

Briefly described, and in accordance with one embodiment thereof, the invention provides a gripping surface for hand-held firearms, the gripping surface including a leather inlay adhesively attached to a bottom surface of an inlay groove disposed in a gripping member of the firearm. In the described embodiment of the invention, an embossed decorative pattern is provided, either by tooling or stamping, in the outer surface of the leather inlay in order to provide a decorative pattern having various adjacent high and low points which produce a gripping surface having sufficient roughness and resiliency to provide an optimum gripping capability desired by the user. In the described embodiment of the invention, the gripping surfaces are provided on wooden removable pistol grips or gripping panels, or on the forearm grip portion of a rifle or shotgun. The inlay grooves are provided by utilizing a high-speed routing machine, which produces the inlay groove coextensive with a pattern traced on the wooden surface from leather inlays to be placed in the inlay grooves such that the inlay grooves have smooth bottom surfaces and depths which are slightly less than the maximum thicknesses of matching or mating leather inlays. After sanding or smoothing the bottom of the inlay groove and applying a sealer thereto, a layer of suitable permanent or semi-permanent adhesive is disposed on the bottom surface of the inlay groove. The mating or matching leather inlays are then aligned with the respective inlay grooves and the inner surfaces of the leather inlays are pushed against the bottom surfaces of the inlay grooves. A finish, such as urethane varnish then is applied to cover both the outer surface of the leather inlays and the exposed surfaces of the wooden gripping members.

DESCRIPTION OF THE INVENTION

Figure 1:
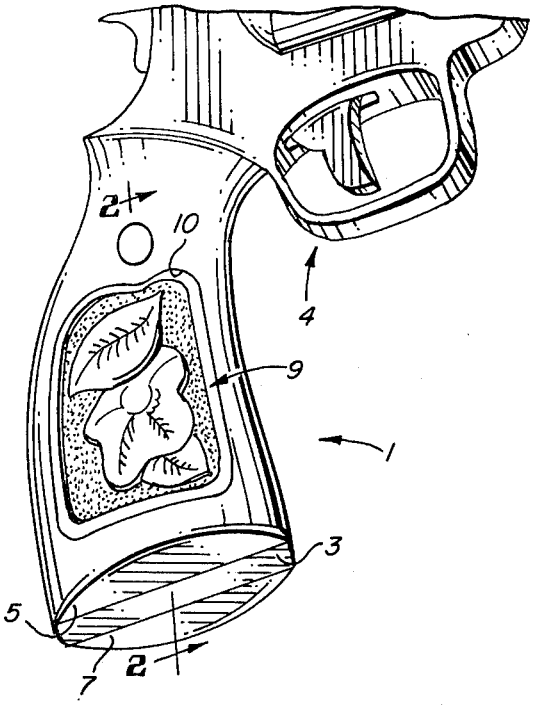
FIG. 1 is a partial perspective view of the handle of a pistol showing one of the leather inlays of the invention.
Figure 2:
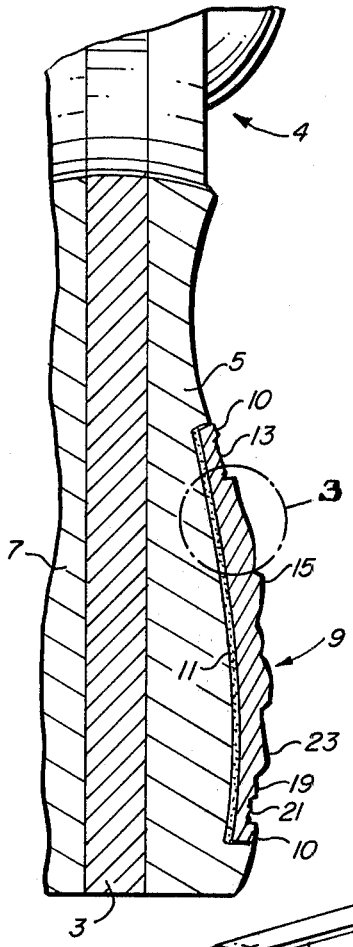
FIG. 2 is a sectional view taken along section line 2—2 of FIG. 1.
Figure 3:
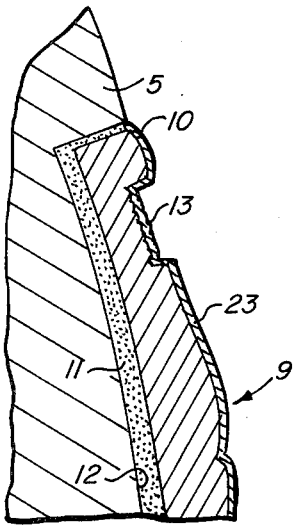
FIG. 3 is an enlarged sectional view of detail 3 of FIG. 2.

Referring now to the drawings, particularly to FIGS. 1–3, a pistol 1 has a metal handle portion 3 to which a pair of wood grip members 5 and 7 are attached by means of screws (not shown). Metal handle portion 3 is attached to the upper portion 4 of pistol 1. A leather inlay 9 (which can be composed of cowhide) is adhesively disposed within an inlay groove 10. As best seen in FIGS. 2 and 3, inlay groove 10 has a side wall which is approximately perpendicular to the outer surface of wood grip member 5 and has a relatively smooth bottom 12 which follows the outer curvature of grip member 5. A layer of suitable adhesive material 11 is disposed between the bottom surface 12 of pistol grip member 5. The bottom surface of leather inlay 9 is adhesively attached to the bottom of inlay groove 10.

Preferably, leather inlay 9 has an embossed pattern on the outer surface thereof. The embossed pattern has a number of low points, such as 13, 19, 21 of FIG. 2 and a number of high points, such as 15 and 23, thereon to provide an effective gripping surface which has a pleasing decorative appearance. The average thickness of leather inlay 9 can be slightly greater than the depth of inlay groove 10; the thickness is sufficiently great that the user can note a slight resiliency of leather inlay 9 which cannot be detected for the previously mentioned hard plastic checkered inlays described previously. This resiliency results in substantially improved and more comfortable gripping ability of leather inlay 9 by the user's trigger finger hand than has been available for any prior firearm gripping surface. Further, the ability of the leather to absorb small amounts of moisture due to perspiration of the user can further enhance the gripping ability of leather inlay 9, if no moisture proof finish is applied to cover the outer surface of the leather. The decorative patterns provided on leather inlay 9 can be widely varied, and can be provided by custom leather tooling utilizing techniques well known to those skilled in the leather tooling art or by means of well known stamping processes.

If desired, a suitable layer of exterior finish 23, FIG. 3, can be provided over the outer surface of leather inlay 9. For example, the exterior finish can be clear, natural varnish, various plastic flexible varnishes, such as polyurethane varnishes, or neetsfoot oil. The same finish material can be applied to the remaining exposed surface of wooden grip member 5.

The adhesive layer 11 can either be a permanent adhesive or can be a semi-permanent adhesive (such as any of a variety of commercially available rubber-based cements or contact cements) which allows leather inlay 9 to be forceably removed from inlay groove 10 to allow another different leather inlay to be adhesively attached within inlay groove 10.

Figure 4:
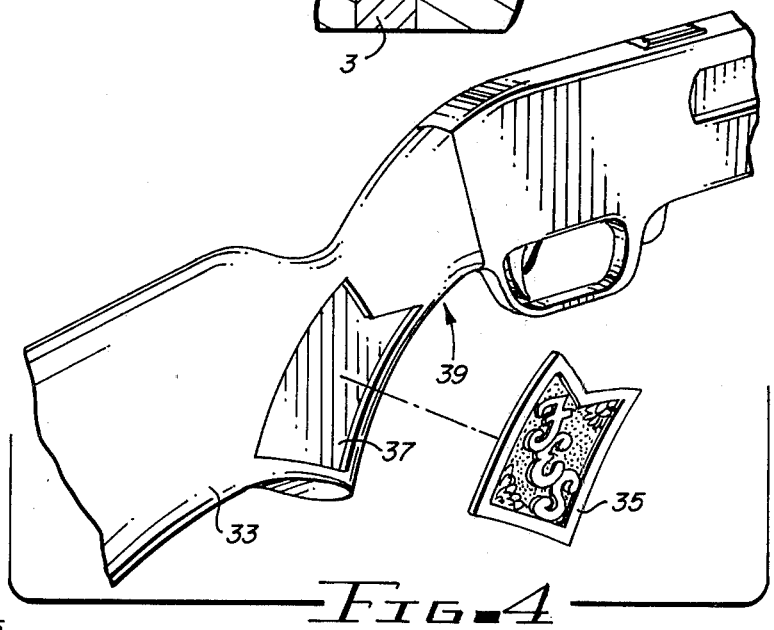
FIG. 4 is a partial perspective exploded view of the pistol grip portion of a gun stock illustrating an inlay groove and a matching leather inlay in accordance with the present invention.
Figure 5:
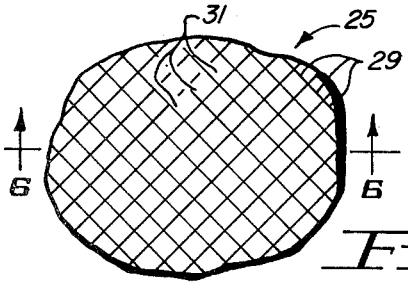
FIG. 5 is a partial plan view showing a checkered surface which can be applied on the outer surface of a leather inlay of the present invention.

As shown in FIG. 4, leather inlay 35, having a custom tooled decorative outer surface thereof, can be adhesively attached within a mating inlay groove 37 disposed in the pistol gripping portion of a gun stock 33 of a shotgun or rifle in precisely the manner described above with reference to pistol 1.

Inlay groove 37 can be formed by means of a small high speed wood routing device, a variety of which are provided by various tool manufacturers. After the routing operation, the bottom surface should be sanded and sealed by applying a layer of suitable wood sealer thereto; various suitable wood sealers are readily available.

Figure 6:
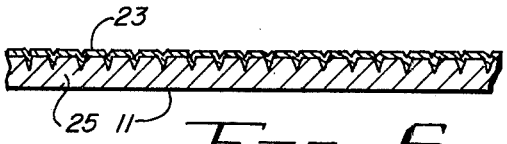
FIG. 6 is a section view taken along section lines 6—6 of FIG. 5 illustrating an exterior coating of finish on the outer surface of the leather inlay of FIG. 5.

Alternatively to the custom decorative patterns shown in FIGS. 1–4, a regular checkered surface can be stamped onto the outer surface of leather inlay 9, as shown in FIG. 6, wherein checkered surface 25 includes a plurality of grooves 31 and a second plurality of grooves 29 which are mutually perpendicular to grooves 31. This approach provides a lower cost but nevertheless effective gripping surface to be utilized on gripping portions of a pistol, rifle or shotgun. In certain instances, one might even utilize leather inlays with no decorative pattern at all on the other surface and still attain some of the benefits of the above described leather inlay gripping surfaces, including improved resiliency and improved moisture absorbtion capabilities.

While the invention has been described with reference to several particular embodiments thereof, those skilled in the art will be able to make various modifications to the described structure and method of manufacture without departing from the true spirit and scope of the present invention. For example, the leather patterns can be colored by artistically utilizing conventional leather dyes.

We claim:

1. A gripping structure for a gun, said gripping structure comprising in combination:

a first gripping member attached to a first side portion of the gun, a first inlay groove being disposed in said first gripping member;

a first layer of adhesive disposed on a bottom surface of said first inlay groove;

a first leather inlay having an inner surface attached by means of said first layer of adhesive to the bottom of said first inlay groove, said first leather inlay having an outer surface, an embossed pattern being disposed on said outer surface, said first leather inlay having a periphery which is substantially coextensive with the periphery of said first inlay groove such that the entire periphery of said first inlay groove fits closely to the entire periphery of said first leather inlay wherein the outer surface of said first leather inlay has a pattern embossed thereon, said embossed pattern having sufficient vertical variation therein to effect improved gripping by the trigger finger hand of the user of the gun, wherein the hardness of said first leather inlay is selected to enhance the gripping capability of said gripping structure by producing a substantially more resilient gripping surface than a wood or thermoplastic gripping surface, and wherein the thickness of said first leather inlay sufficiently exceeds the depth of said first inlay groove to make the resiliency of said first leather inlay readily detectable by the user as his trigger finger hand grips said gripping structure, said gripping structure further including a second gripping member similar to said first gripping member disposed on an opposed portion of the gun, a second inlay groove in said second gripping member substantially similar to said first inlay groove, and a second leather inlay substantially similar to said first leather inlay adhesively disposed within said second inlay groove, said first and second inlay grooves being located to hold said first and second leather inlays, respectively, at locations which cause portions of said trigger finger hand to grip said first and second leather inlays during normal firing of the gun.

2. The gripping structure of claim 1 wherein said gun is a pistol and said first gripping member is a removable pistol grip member.

3. The gripping structure of claim 1 wherein said gun is a rifle, and said first gripping member is a gun stock of said rifle and said first leather inlay and said first inlay groove are disposed along a pistol grip portion of the gun stock.

4. The gripping structure of claim 1 wherein said gun is a shotgun.

5. The gripping structure of claim 1 wherein said first grip member is composed of wood.

6. The gripping structure of claim 5 wherein the thickness of said first leather inlay is greater than the depth of said first inlay groove.

7. The gripping structure of claim 1 wherein said embossed pattern is a decorative pattern.

* * * * *